United States Patent [19]

Maisch et al.

[11] 4,326,487

[45] Apr. 27, 1982

[54] FUEL INJECTION SYSTEM

[75] Inventors: Wolfgang Maisch, Schwieberdingen; Klaus-Jürgen Peters, Affalterbach; Michael Wissmann, Gerlingen; Peter Schelhas, Stuttgart, all of Fed. Rep. of Germany

[73] Assignee: Robert Bosch GmbH, Stuttgart, Fed. Rep. of Germany

[21] Appl. No.: 132,056

[22] Filed: Mar. 20, 1980

[30] Foreign Application Priority Data

May 8, 1979 [DE] Fed. Rep. of Germany ..... 2918401

[51] Int. Cl.[3] ..... F02M 39/00

[52] U.S. Cl. ..... 123/453; 123/454

[58] Field of Search ..... 123/453, 454

[56] References Cited

U.S. PATENT DOCUMENTS

| | | | |
|---|---|---|---|
| 3,963,005 | 6/1976 | Eckert | 123/453 |
| 3,983,849 | 10/1976 | Stumpp | 123/454 |
| 3,994,267 | 11/1976 | Eisele | 123/454 |
| 3,999,527 | 12/1976 | Wessel | 123/454 |
| 4,007,722 | 2/1977 | Knapp | 123/454 |
| 4,161,933 | 7/1979 | Stumpp | 123/454 |

*Primary Examiner*—Ronald B. Cox

*Attorney, Agent, or Firm*—Edwin E. Greigg

[57] ABSTRACT

A fuel injection system is proposed which brings about an improvement in the acceleration behavior of an internal combustion engine. The fuel injection system includes an intake manifold having a measuring device arranged therein which is moved against a restoring force in accordance with the quantity of air flowing therethrough and thereby actuates the control slide of a distribution valve. The restoring force on the air flow measuring device is actuated by fuel, supplied by a fuel pump via a damping throttle, which operates within a pressure chamber into which the control slide protrudes by means of an end face. A check valve is arranged in a discharge line between the pressure chamber and the delivery side or the suction side of the pump, and opens above a predetermined pressure within the pressure chamber. This allows a rapid unloading of the pressure chamber and a rapid response of the fuel injection system in the case of an acceleration.

1 Claim, 1 Drawing Figure

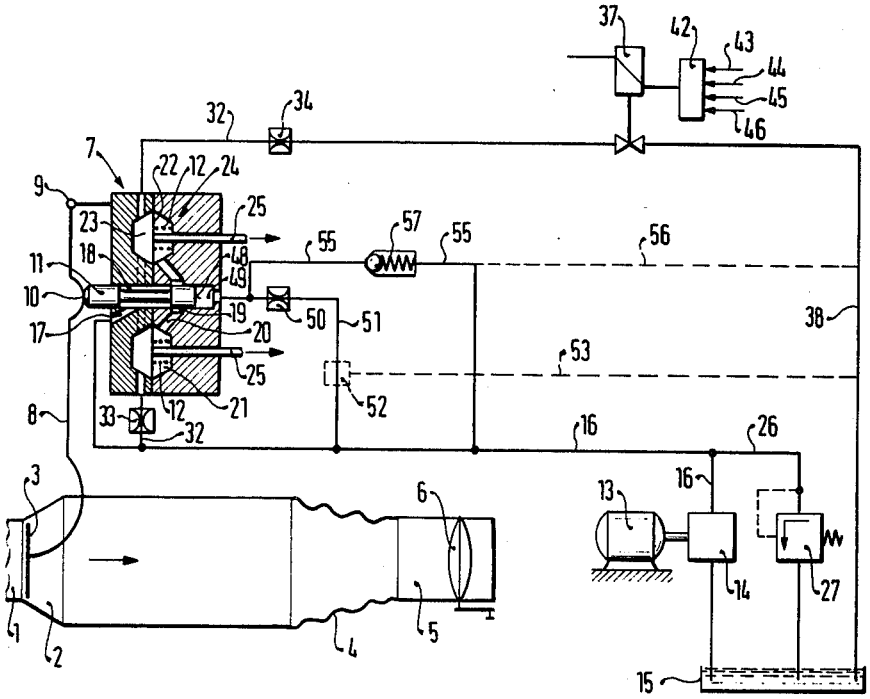
37
42
43
44
45
46
32
34
7
22
12
24
9
23
25
18
11
10
17
48
49
19
20
25
21
12
33
32
8
3
1
2
4
5
6
55
57
55
56
50
51
38
53
52
16
26
16
13
14
27
15

FUEL INJECTION SYSTEM

BACKGROUND OF THE INVENTION

The invention relates to a fuel injection system. Already known is a fuel injection system in which a diaphragm valve is controllable in dependence on the pressure gradient against a damping restriction disposed between the pressure chamber and the control pressure line, in order to unload the pressure chamber during a period of acceleration and to maintain an adequate acceleration enrichment during the warming-up phase of the internal combustion engine.

OBJECT AND SUMMARY OF THE INVENTION

The fuel injection system of the invention has the advantage to insure that a sufficient fuel quantity is supplied to the engine during the acceleration phase, this being done in a simple way and without any increased costs of construction.

The invention will be better understood and further objects and advantages thereof will become more apparent from the ensuing detailed description of a preferred embodiment taken in conjunction with the drawing.

BRIEF DESCRIPTION OF THE DRAWING

An examplary embodiment of the invention is illustrated schematically in the single FIGURE of the drawing and explained in more detail in the description.

DESCRIPTION OF THE PREFERRED EMBODIMENT

Turning now to the FIGURE, in the fuel injection system shown in the drawing, the air required for combustion flows in the direction of the arrow into an intake manifold section 1, a conical section 2 having a measuring device 3 arranged therein and further through a connecting conduit 4 and an intake manifold section 5 having an arbitrarily actuatable throttle valve 6 to one or more cylinders, not shown, of mixture-compressing internal combustion engine with externally-supplied ignition. The measuring device 3 is a plate disposed transversely to the direction of air flow, which moves within the conical section 2 of the intake manifold, by way of example, in accordance with an approximately linear function of the quantity of air flowing through the intake manifold; at a constant restoring force which engages the measuring device 3 and a constant air pressure prevailing ahead of the measuring device 3, the pressure prevailing between the measuring device 3 and the throttle valve 6 likewise remains constant.

The measuring device 3 directly controls a metering and distribution valve 7. A lever 8 connected therewith serves to transmit the adjustment motion of the measuring device 3 onto the metering and distribution valve 7. The lever 8 is pivotable about a rotation point 9 attached to the housing and during its pivoting motion actuates with a nose 10 the movable valve element of the metering and distribution valve 7, which is embodied as a control slide 11.

The fuel, supplied for instance by a fuel pump 14 driven by means of an electromotor 13, flows out of a fuel container 15 and through a fuel supply line 16 and a channel 17 into an annular groove 18 of the control slide 11. Depending upon the position of the control slide 11, the annular groove 18 overlaps control slits 19, which lead through channels 20 to one chamber 21 for each slit, to a greater or lesser extent. The chamber 21 is separated by a diaphragm 22 from a control chamber 23, and the diaphragm 22 acts as the movable element of one control valve 24 per chamber 21. From the chambers 21, the fuel proceeds via injection channels to the individual injection valves, not shown, which discharge into the intake manifold in the region of the engine cylinders. The control valves 24 may be embodied as differential pressure valves having, by way of example, compression springs 12 disposed in the chambers 21, as shown; or, as not shown, they may be embodied as equal-pressure valves without compression springs.

A line 26, into which a pressure limitation valve 27 is inserted, branches off from the fuel supply line 16. Through this line 26, the fuel can flow back into the fuel container 15.

A control pressure line 32 also branches off from the fuel supply line 16. Disposed in series in this control pressure line 32 are a first throttle 33, the control chambers 23 of the control valves 24, a second throttle 34 and an electromagnetic valve 37, by way of which the fuel in the control pressure line 32 can flow back, pressure-free, through a return flow line 38 to the fuel container 15. The electromagnetic valve 37 is actuatable by means of a known electric control apparatus 42, into which operational characteristics of the engine, indicated by way of example by arrows, can be fed after being converted to electrical values. These characteristics may be the exhaust gas composition 43, ascertained by an oxygen sensor, for instance; the air temperature 44; a signal 45 which characterizes the acceleration mode; or the throttle valve position 46.

The control slide 11 protrudes with its end face 48 remote from the lever 8 into a pressure chamber 49, which communicates via a damping throttle 50 and a line 51 with the fuel supply line 16. The pressure of the fuel in the pressure chamber 49 on the end face 48 of the control slide generates the restoring force exerted upon the measuring device 3. Pulsations in the pressure chamber, caused by the pulsations in air flow acting upon the measuring device 3, are damped by means of the damping throttle 50. A pressure control valve 52, which could also be built as an electromagnetic valve for instance, could be placed in the line 51, as marked in broken lines on the drawing; by means of this valve, the pressure in the line 51, together with that in the pressure chamber 49, would be controllable in dependence of the operational characteristics of the engine. A line 53 can be provided between the pressure control valve 52 and the return flow line 38.

Likewise, a discharge line 55, which can be coupled on the other side with the delivery side of the pump, i.e., the fuel supply line 16, or else with the suction side of the pump, for instance the return flow line 38 as indicated with broken lines on the drawing, is connected to the pressure chamber 49. A check valve 57, which opens toward the fuel supply line 16 or toward the return flow line 38 at a predetermined pressure, is disposed within the discharge line 55, 56. The predetermined pressure should lie at a higher level than the pressure of the fuel injection system.

The mode of operation of the fuel injection system illustrated on the drawing is as follows:

When the engine is running, air is induced via the intake manifold 1, 4 and 5, which causes a certain amount of deflection of the measuring device 3 out of its position of rest. The control slide 11 of the metering and distribution valve 7 is also displaced in accordance with the amount of deflection of the measuring device 3; the control slide 11 thus being arranged to meter the quantity of fuel flowing to the injection valves.

In order to keep the fuel-air mixture at a richer or leaner level in accordance with the operational characteristics of the engine, a variation is necessary in the proportionality between the induced air quantity and the metered fuel quantity, depending on these operational characteristics. The variation of the fuel-air mixture may advantageously be effected by means of varying the differential pressure at the metering and distribution valve 7. In the present exemplary embodiment, the variation of the differential pressure occurs at the control slits 19 of the metering valves 18, 19 by means of the subdivision of the pressure at the first throttle 33 and the second throttle 34, by means of the variable fuel quantity which flows through the electromagnetic valve 37. The fuel quantity flowing in the control pressure line 32 when the electromagnetic valve 37 is opened is determined only by the throttles 33 and 34 and by the throttling of the electromagnetic magnetic valve 37, so that the pressure difference at the control slits 19 of the metering valve 18, 19 as well is at maximum.

Thus, when the electromagnetic valve 37 is opened, the highest enrichment rate results—that is, the richest fuel-air mixture, because when the induced air quantity remains the same, the maximum pressure difference at the control slits 19 of the metering valves 18, 19 produces the maximum metered fuel quantity. The electromagnetic valve 37 is advantageously actuated in a so-called cylic fashion; that is, the ratio of the length of the opened time of the electromagnetic valve 37 to the closed time is varied.

Now, if the engine is abruptly accelerated—that is, the throttle valve 6 is abruptly opened—then an increased adjusting force results at the measuring device 3, and the control slide 11 urges the fuel out of the pressure chamber 49 through the line 51 and into the fuel supply line 16. Because the fuel flows out of the pressure chamber 49 via the damping throttle 50 with retardation, said pressure chamber 49 is the seat of a temporary increase of pressure which prevents the control slide 11 and the measuring device 3 from assuming a position required by driving conditions, so that the control slits 19 are not opened wide enough and the fuel quantity metered at the control slits 19 during this retardation phase is not sufficient for accelerating the vehicle. For this reason, the invention teaches that the pressure chamber 49 is connected with the discharge line 55, 56 in which the check valve 57 is disposed; said check valve 57 being arranged to open toward the fuel supply line 16 or the return flow line 38 in the case of an acceleration of the engine during which an increase in pressure, higher than the pressure of the system, occurs in the pressure chamber 49. Thus, fuel can be rapidly urged out of the pressure chamber 49 during an acceleration, and the control slide 11 can open the control slits 19 to meter the quantity of fuel required for acceleration without delay.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a fuel injection system for mixture compressing externally ignited internal combustion engines comprising an air suction tube, a measuring member and an arbitrarily actuatable butterfly valve movably disposed in said suction tube with said measuring member upstream from said butterfly valve, a fuel metering and distribution valve, a fuel supply line connected to said fuel metering and distribution valve, a movable fuel metering control slide in said metering and distribution valve, a control lever secured to said measuring member and operative relative to said control slide which is subjected to a restoring pressure force for exerting a resetting force on said measuring member, said measuring member being mounted for movement by flowing air depending on an air flow rate through said suction tube and in opposition to a resetting force of said control slide wherein the flowing air displaces said measuring member which displaces said control slide for the purpose of metering out a fuel quantity in proportion to the air quantity, the control slide metering taking place normally while substantially a constant pressure difference prevails, said pressure being variable in accordance with operational characteristics of said engine, said metering and distribution valve including a pressure chamber therein relating to said control slide, said control slide including an end face that protrudes into said pressure chamber, a fuel feed line connected to said pressure chamber for applying a resetting force on said control slide, a damping throttle in said fuel feed line, a fuel discharge line connected to said fuel feed line between said damping throttle and said pressure chamber, and a check valve disposed in said discharge line between said pressure chamber and the delivery side of a fuel pump opens above a predetermined pressure in the pressure chamber.

* * * * *